United States Patent [19]

Poley et al.

[11] 4,091,305

[45] May 23, 1978

[54] GAS PANEL SPACER TECHNOLOGY

[75] Inventors: Neil Myron Poley, Kingston; Marvin Benjamin Skolnik, Poughkeepsie, both of N.Y.

[73] Assignee: International Business Machines Corporation, Armonk, N.Y.

[21] Appl. No.: 756,525

[22] Filed: Jan. 3, 1977

Related U.S. Application Data

[63] Continuation of Ser. No. 647,681, Jan. 8, 1976, abandoned.

[51] Int. Cl.[2] ..... H01J 61/30

[52] U.S. Cl. ..... 313/220; 29/25.11; 29/25.13; 313/188

[58] Field of Search ..... 313/220, 188, 201; 29/25.11, 25.13

[56] References Cited

U.S. PATENT DOCUMENTS

| | | | |
|---|---|---|---|
| 3,499,167 | 3/1970 | Baker et al. | 313/220 X |
| 3,998,510 | 12/1976 | Salisbury | 313/220 X |

OTHER PUBLICATIONS

IBM Technical Disclosure Bulletin, vol. 16, No. 7, Dec. 1973, p. 2057.

IBM Technical Disclosure Bulletin, vol. 16, No. 12, May 1974, pp. 3988–3989.

IBM Technical Disclosure Bulletin, vol. 18, No. 6, Nov. 1975, pp. 1923–1926.

*Primary Examiner*—James B. Mullins
*Assistant Examiner*—Darwin R. Hostetter
*Attorney, Agent, or Firm*—Joseph J. Connerton

[57] ABSTRACT

A gaseous discharge display and/or memory device comprises a pair of sealed glass plates having metallic conductor arrays formed thereon and insulated from contact with the gas by a dielectric layer. The crossover points of the conductors define the locations of the individual cells which are controlled by selective application of write, sustain, and erase signals. To permit uniform operation of individual cells, the plates must be maintained precisely spaced over their entire display surface. To effect this requirement in a large size panel, metallic spacers are secured to the upper surface of the conductors of the metallic conductor arrays prior to the formation of the dielectric layer, the size and number of these spacers being determined by the geometry and resolution of the gaseous discharge display device.

11 Claims, 2 Drawing Figures

GAS PANEL SPACER TECHNOLOGY

This is a continuation, of application Ser. No. 647,681 filed Jan. 8, 1976 now abandoned.

CROSS REFERENCE TO RELATED APPLICATIONS

U.S. Application Ser. No. 886,100 "Gas Cell Type Memory Panel with Grid Network for Electrostatic Isolation" filed by Frank M. Lay, Dec. 18, 1969, now U.S. Pat. No. 3,666,981.

U.S. Application Ser. No. 405,205 "Gas Panel Fabrication" filed by Peter H. Haberland et al Oct. 10, 1973, now U.S. Pat. No. 3,837,724.

U.S. Application Ser. No. 214,298 "Sealing Technique for Gas Panel" filed by Perry R. Langston, Jr. et al, Dec. 30, 1971, now U.S. Pat. No. 3,778,127.

BACKGROUND OF THE INVENTION

This invention relates to gaseous discharge display and/or memory devices and more particularly to large size high resolution devices of this type embodying a method of spacing the plates with spacer elements that does not inhibit flow of gas particles within the panel, which are substantially invisible and which can be interspersed across the display surface at predetermined or random intervals in accordance with the size of the panel and the specific geometric design of the conductor arrays.

Various methods have been employed in the prior art for maintaining a uniform space or gap between opposing walls of a gas discharge device, primarily involving the use of glass spacers generally in rod form, and various methods of gas panel assembly using such spacers have been proposed. In one arrangement, disclosed in U.S. Pat. No. 3,808,497 to Greeson, Jr. et al, hard glass spacer rods and soft glass sealing rods are spaced about the periphery of a panel during the sealing cycle whereby the space between the plate is controlled by the peripheral glass spacer rods when the glass sealant reflows. In other arrangements for utilizing glass rods in a gas panel fabrication, grooves can be cut in the panel subassembly by scoring the dielectric after reflow to position and retain the glass spacer rods in position during the fabrication of the panel. However, it is essential that the rods maintain their position during assembly with utmost precision so as to avoid intrusion into the operative portions of the display area. This presents a difficult problem in fabrication since the rods are of such dimensions as to make handling extremely difficult and further tend to move readily even from their grooved position during the fabrication process so that additional care must be exercised in the fabrication to prevent lateral movement of the rods.

While this method has been employed successfully albeit with the problems enumerated above, the method of framing the display area with rod glass spacers is limited to panels where the plates are relatively small. As the display area and hence the plate size are increased, spacer means must be introduced at intermediate locations within the chamber to maintain the critical precise spacing between the plates. In methods employed for medial spacing in the prior art, glass spacer rods are positioned between adjacent rows or columns of cells rather than obstruct the display area, thus tending to limit the resolution of the panel. Additionally, glass spacer elements having medial locations in the panel tend to be visible and are considered undesirable from an aesthetic standpoint. Finally, the problem of positioning and maintaining the spacer rods in position at the medial location within the panel during fabrication remains. The length of the sealing rods must be limited since they may tend to impede the flow of gas particles and metastables between adjacent areas separated by such spacer rods. Thus there is need for a spacer technology which will provide uniform spacing between glass plates, particularly in gaseous discharge devices having large display areas of high resolution. It would also be desirable to minimize the size of the spacer elements and at the same time provide greater latitude in their location for aesthetic reasons so so they will not be visible and mar the display area.

SUMMARY OF THE INVENTION

Toward this end and according to the present invention, applicants have found that these objectives can be achieved by an improved gaseous discharge display and/or memory device and method which insofar as known has never heretofore been proposed. In this device and according to applicants' improved spacing method, the plates are held precisely spaced at preselected, constant distances by metallic spacer elements which are attached directly to the metallic conductors prior to the reflow of dielectric over the conductor arrays. In the embodiment using only drive lines, the spacers could be positioned at locations not required for display such as the area between adjacent conductors in the vertical direction or the area between rows of conductors in the horizontal direction. In another embodiment of the invention utilizing drive lines interspersed by shield lines as taught in the aforenoted Lay U.S. Pat. No. 3,666,981, the spacers may be attached directly to the shield lines and will not effect the display. The size of the spacer elements is controlled so as not to impede the flow of charge particles within the panel, and the number and location of the spacer elements may be selected or varied in accordance with the geometry of the panel. Various metals may be used for the spacer elements and conventional techniques are known in the art for attaching the metallic spacer elements to the conductors.

Accordingly, a primary object of the present invention is to provide an improved means and method for maintaining a predetermined uniform distance between the plates of a gas panel assembly.

Another object of the present invention is to provide an improved spacer technology for a gaseous discharge display and/or memory device.

Another object of the present invention is to provide an improved spacer technology using metallic spacers attached to conductor arrays which can accommodate panels of varying size and geometry and which are normally not possible on the display.

The foregoing and other objects, features and advantages of the present invention will be apparent from the following more particular description of preferred embodiments of the invention as illustrated in the accompanying drawings.

DESCRIPTION OF A PREFERRED EMBODIMENT

Figure 1:
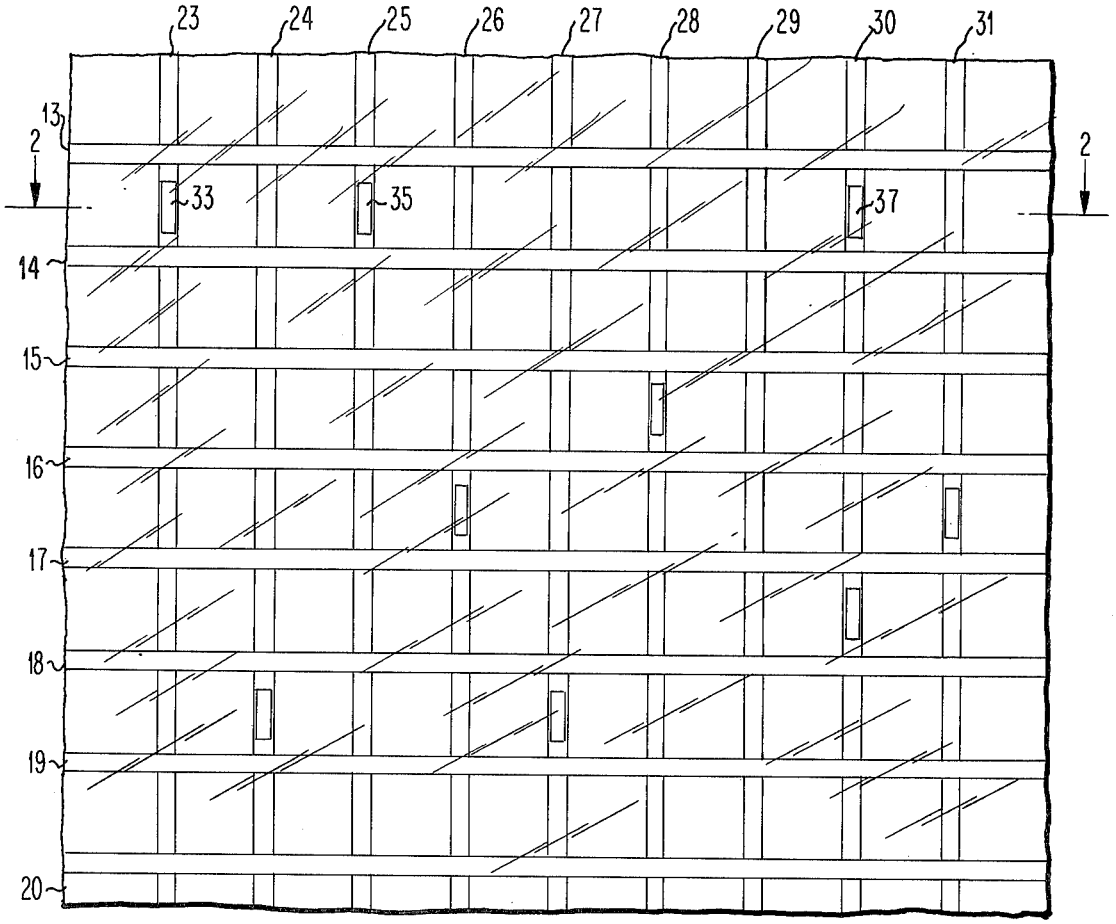
FIG. 1 is an enlarged plan view of a portion of a gaseous discharge display device illustrating one embodiment of the present invention.
Figure 2:
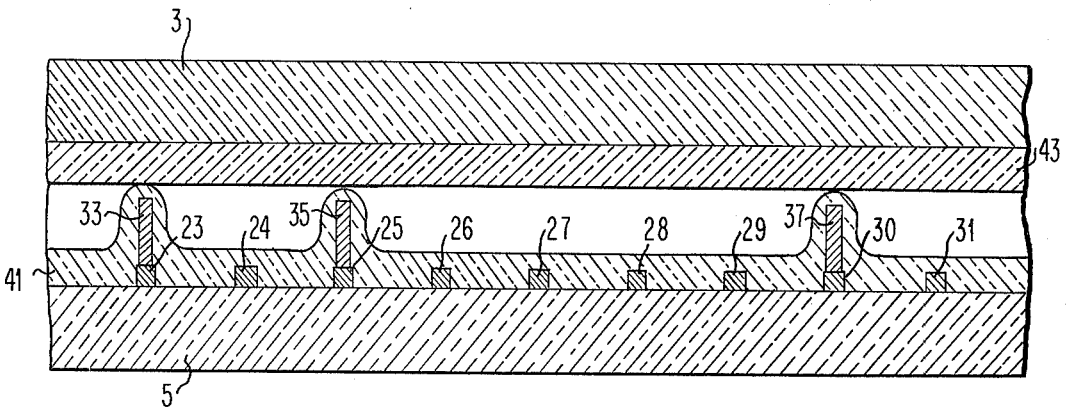
FIG. 2 illustrates a sectional view of the device shown in FIG. 1 taken along the lines to 2—2 of FIG. 1.

Referring now to the drawings and more particularly to FIG. 1 thereof, there is illustrated a schematic plan view of a portion of a gas panel display. The gas panel assembly of the instant invention corresponds generally to that shown and described in the referenced Haberland et al U.S. Pat. No. 3,837,724, and the fabrication details are similar except as they relate to details of the instant invention pointed out below. The illustrated section comprises a matrix of horizontal and vertical lines including horizontal lines 13–20 and vertical lines 23–31 respectively. The conductor arrays for such devices, typically utilize the same space between conductors as the conductor width, and a representative width is 4 mils. The horizontal lines 13–20 comprise the upper conductor array and are mounted on substrate or plate 3, while the vertical lines 23–31 comprise the lower conductor array mounted on substrate 5 (FIG. 2). In a gas panel fabrication, conductor arrays are formed of the respective glass plates or substrates, and in one preferred embodiment (Haberland et al U.S. Pat. No. 3,837,724) comprise chrome-copper-chrome conductors in which the intermediate copper layer functions as a conductor, the layer adjacent to the glass plate provides adhesion to the plate and the other chrome layer protects the copper from attack by the active glass components during the fabrication process. Alternatively, conductors of gold, aluminum, nickel or various alloys could be suitably employed.

In the illustrated embodiment of the invention, metallic spacers such as spacers 33, 35, and 37 are formed on associated vertical conductors 23, 25, and 30 respectively. The metallic spacers, which might comprise nickel for example, may be attached directly to the associated conductors by any of various conventional processes for metal-to-metal bonding such as thermocompression bonding, ultrasonic compression bonding, stitch bonding, etc. In terms of actual size, the conductors in a typical gas panel configuration might be 4 mils wide with a 4 mil gap between lines. Accordingly, the spacers in the illustrated embodiment are slightly less size than their associated conductors for ease of placement, and could be in ribbon wire form. It should be emphasized that the drawings of the instant application are not to scale but are merely a schematic representation of the conductor arrays of a gas panel and are not intended to portray specific parameters relating to conductor size, resolution or other structural details of a gas panel assembly which are well known in the art. Preferably extra lines such as vertical lines between characters or horizontal lines between character rows are used for placement of the spacers. Depending on panel construction, additional lines could be incorporated in the conductor array configurations for this purpose. While the spacers are shown mounted on the vertical drive lines in the illustrated embodiment, the spacers could alternatively be mounted on the horizontal drive lines or on both sets of lines. Likewise, while the preferred embodiment is shown with individual spacers mounted on a single substrate, the invention could comprise metallic spacers of half the gap as spacers 33 mounted on corresponding positions on opposite sides of the panel whereby the sum of the two spacers is equal to that of the desired gap between panel walls. Further, the specific design of the spacer is not material, and spacers could be formed in a disk or square configuration. In either embodiment the disk diameter or side of the square would be slightly less than the conductor width.

With respect to the size of the conductors relative to that of the spacers, a relative but not precise variation is shown in FIG. 2. Conductor thickness such as described by Haberland et al U.S. Pat. No. 3,837,724 might be typically 20–25 Microns or approximately 1 mil, while the height of the spacer is typically 4 mils to provide a 4 mil gap. As shown more clearly in FIG. 2, when spacers 33, 35 and 37 are fastened to conductors 23, 25 and 30 respectively, a layer of dielectric 31 is applied by spraying or some suitable technique and reflowed such that the dielectric layer across the top of the spacer corresponds substantially to the thickness of the dielectric layer over the conductor array. The sectional view in FIG. 2 illustrater that dielectric layer 41, formed over the vertical conductor array, is also formed over spacers 33, 35 and 37 such that a uniform gap between the two dielectric layers 41 and 43 is provided. By using malleable wire for the spacer elements rather than glass rods, cracking or crazing which occurs with glass spacer rods together with the associated resulting impurities within the viewing area caused by these particles is eliminated.

As previously noted, techniques for bonding metallic spacers to conductors are well developed, and placement of the spacers on the conductor arrays could be controlled by a modified X–Y table with a wire bonding head to place the spacers at the desired locations under digital programming control, the same technique employed in artwork. The only requirement relative to positioning other than that defined above is that the spacers must not be long enough or so closely positioned that they interfere with the normal fow of charge particles and metastables which is essential to gas panel operation. This represents the only limitation on number and placement of spacers.

DESCRIPTION OF ALTERNATE EMBODIMENT

In addition to the preferred embodiment illustrated and described above, another arrangement for providing a high resolution panel would utilize a panel of the type disclosed in the referenced Lay U.S. Pat. No. 3,666,981. In this embodiment, shield lines are positioned between the normal conductor lines in an alternate configuration on one or both conductor arrays, and the shield lines are connected to a source of common potential. Using this configuration, the spacers are positioned on the normal shield lines which are not involved in the discharge but positioned adjacent thereto, are invisible to an observer and do not interfere in any manner with the normal flow of metastables and charge particles within the panel.

It is to be understood that the conductor configuration and composition, the specific method of fabrication and the apparatus by which the chamber 23 is evacuated and then charged with illuminable gas are known in the art and disclosed for example the above referenced Langston et al U.S. Pat. No. 3,778,127 and Haberland et al U.S. Pat. No 3,837,724. Accordingly such details have been omitted in the instant application since they are not considered necessary for an understanding of the present invention.

While the invention has been shown and described with reference to preferred embodiments thereof, it will be understood that various substitutions and changes in form and detail may be made by those skilled in the art without departing from the spirit and scope of the invention. Accordingly, the gas discharge display and/or memory device herein disclosed and the method of making same are to be considered as merely illustrative and the scope of the invention is to be limited only as specified in the claims.

What is claimed is:

1. A gaseous discharge display device comprising in combination, a pair of glass plates, said glass plates including a substrate with a plurality of parallel conductors formed thereon and overlaid with a dielectric coating, means for sealing said plates in superimposed spaced parallel relation with said dielectric surfaces adjacent to provide a sealed chamber containing an illuminable gas, the conductors on one of said plates being substantially orthogonal to the other and, spacer means for maintaining said dielectric surfaces precisely spaced at a preselected constant distance, said spacer means comprising a plurality of metallic spacer elements positioned on predetermined ones of said plurality of conductors at nondisplay locations within said chamber, the height of said spacer elements corresponding to said preselected constant distance, said spacer elements being adapted to fit on said conductor without restricting the flow of particles within said sealed chamber.

2. A gaseous discharge display device comprising in combination, a pair of glass plates, said glass plates including a substrate with a plurality of conductors formed thereon and overlaid with a dielectric coating, means for sealing said plates in superimposed parallel relation with said dielectric surfaces adjacent to provide a sealed chamber containing an illuminable gas, the conductors on one of said plates being disposed substantially orthogonal to the conductors on said other plate, the intersections of said drive lines defining discharge sites, and spacer means for maintaining a uniform discharge gap between opposite dielectric surfaces, said spacer means comprising a plurality of metallic spacer elements positioned on predetermined conductors on at least one of said plates within said chamber, the height of said spacer elements corresponding to said uniform discharge gap, said spacer elements having a configuration adapted to fit on said predetermined conductors without restricting the flow of particles within said chamber.

3. A device of the type claimed in claim 2 wherein said spacer elements are attached directly to said conductors prior to said dielectric coating overlay.

4. A device of the type claimed in claim 2 wherein said metallic spacer elements are located on non-display portions of said panel.

5. A device of the characters claimed in claim 4 wherein said metallic spacer elements are comprised of malleable wire having a configuration smaller than the associated conductors to which they are attached.

6. A device of the type claimed in claim 4 wherein said non-displayable locations correspond to non-display areas in said plurality of conductors.

7. A device of the type claimed in claim 6 wherein said configuration of said metallic space elements is rectangular.

8. A device of the type claimed in claim 6 wherein said configuration of said metallic spacer elements is disk shaped.

9. A method of fabricating a glass discharge display device comprising the steps of, providing two substantially transparent members each with conductor arrays including drive lines thereon, attaching a plurality of metallic spacer elements to predetermined conductors on at least one of said arrays whereby said spacer elements are disposed at predetermined positions to maintain a uniform discharge gap between opposing surfaces of said transparent members, applying a coating of dielectric material over said conductor arrays and said spacing members, disposing heat fusible sealing material over the dielectric material on the border regions of one of said transparent members, positioning said second transparent member on said first transparent member whereby said conductor arrays on said transparent members are substantially orthogonal, and heating the assemblage of said transparent members above the softening point of said heat fusible sealing material to create an impermeable chamber for confining a volume of gas whereby the height of said spacer elements determines said discharge gap between said members.

10. A method of the character claimed in claim 9 wherein said spacer elements are attached to said conductors at non-display areas.

11. A method of the type claimed in claim 9 wherein said metallic spacer elements are attached to both conductor arrays or orthogonal intersections thereof.

* * * * *